United States Patent [19]

Tani, formerly Nishikawa et al.

[11] 4,032,229

[45] June 28, 1977

[54] CONSTRUCTION OF ELECTROPHOTOGRAPHIC COPYING MACHINES WITH A CLEANING UNIT FOR PHOTOSENSITIVE SURFACE

[75] Inventors: Tatsuo Tani, formerly Nishikawa, Tokyo; Susumu Tatsumi, Kawasaki; Mitsuo Tanaka, Sagamihara; Sakae Ota, Tokyo; Akira Midorikawa, Yokohama, all of Japan

[73] Assignee: Ricoh Co., Ltd., Japan

[22] Filed: Jan. 9, 1976

[21] Appl. No.: 647,813

[30] Foreign Application Priority Data

Jan. 14, 1975 Japan ..... 50-6713

[52] U.S. Cl. ..... 355/15; 15/256.52; 118/652; 355/10

[51] Int. Cl.[2] ..... G03G 21/00

[58] Field of Search ..... 355/3 R, 3 DR, 3 TR, 355/10, 15; 118/70, 104, 203, DIG. 23, 652; 15/1.5, 256.51, 256.52, 256.53

[56] References Cited

UNITED STATES PATENTS

| | | | |
|---|---|---|---|
| 3,671,119 | 6/1972 | Engel et al. | 355/3 R |
| 3,689,146 | 9/1972 | Ito et al. | 355/3 DR X |
| 3,752,119 | 8/1973 | Matkan | 355/10 X |
| 3,835,779 | 9/1974 | Ross et al. | 15/256.52 X |
| 3,859,691 | 1/1975 | Katayama et al. | 15/256.51 |
| 3,907,423 | 9/1975 | Hayashi et al. | 355/10 |
| 3,947,108 | 3/1976 | Thettu et al. | 355/15 |

OTHER PUBLICATIONS

Oldenboom; D. J., "Electromechanical Transfer Mechanism", IBM Technical Disclosure Bulletin; vol. 1, No. 3, Oct. 1958, pp. 4 & 5.

Davidge et al.; "Force Loaded Cleaning Station", IBM Technical Disclosure Bulletin; vol. 16, No. 4, Sept. 1973, pp. 1265 & 1266.

*Primary Examiner*—Fred L. Braun

*Attorney, Agent, or Firm*—McGlew and Tuttle

[57] ABSTRACT

The electrophotographic copying machines are of the type in which a photosensitive drum is removable from the machine, for inspection or other purposes, through an opening formed in a sidewall, which opening is normally covered by a coverplate. Plural cleaning devices which are normally maintained in pressing engagement with the peripheral drum surface, are automatically released from such engagement once the coverplate has been dismounted from the sidewall and also returned to the original position as the coverplate is remounted, thereby preventing damage of the drum as well as a wrong usage of the machine which may be caused by inadvertently failing to reset each cleaning device. The construction is further effective to adjust the respective forces with which the cleaning devices are pressed against the peripheral drum surface and moreover to deenergize a motor or motors, for driving the drum and/or other movable parts, as the cleaning devices are lifted from engagement with the drum surface, thereby permitting an inspection of such movable parts in operation even after the coverplate has been dismounted from the sidewall.

9 Claims, 9 Drawing Figures

CONSTRUCTION OF ELECTROPHOTOGRAPHIC COPYING MACHINES WITH A CLEANING UNIT FOR PHOTOSENSITIVE SURFACE

BACKGROUND OF THE INVENTION

The invention relates to an improvement in the construction of an electrophotographic copying machine with a cleaning unit for a photosensitive surface thereof.

An electrophotographic copying machine includes a photosensitive member, on the surface of which an electrostatic latent image corresponding to an original to be copied is formed and subsequently converted into a visual image by the use of a developing solution containing a toner. The visual image is transferred onto a record sheet to provide a copy. In the process described, after the transfer step has been conducted to transfer the visual image onto the record sheet, there remains a certain amount of toner on the photosensitive surface, which must be removed before commencing the next copying cycle. To this end, a variety of cleaning units are known, which include blades formed of a resilient material, such as a sponge roller held in abutment against the photosensitive member and supplied with a cleaning liquid, such as a toner-containing liquid, to remove any residual toner. A recent trend toward an increase in the speed of a copying operation has made it difficult to remove a residual toner completely with a single cleaning member, so that copying machines having an operation cycle of a reduced duration, or adapted to operate with an increased supply of toner, are provided with a plurality of cleaning members which are disposed along the direction of movement of the photosensitive member in an attempt to provide a complete removal of any residual toner.

However, conventional cleaning units including a plurality of cleaning members have been constructed as a mere juxtaposition of independent cleaning members, which requires a troublesome dismounting operation when the photosensitive member is disassembled for the purpose of replacement, inspection, or adjustment, or in the event of occurence of a paper jamming. Sometimes the photosensitive surface of the member may be damaged by one of the cleaning members which has been inadvertently left in position. Additionally, when the individual cleaning members are mounted in place again, they must be individually adjusted so as to provide an adequate contact pressure with respect to the photosensitive member. As the number of the cleaning members increases, some of them may be left without adjustment.

SUMMARY OF THE INVENTION

It is an object of the invention to provide an electrophotographic copying machine with a cleaning unit for a photosensitive surface thereof which completely avoids the above disadvantages.

DETAILED DESCRIPTION OF EMBODIMENTS

Figure 1:
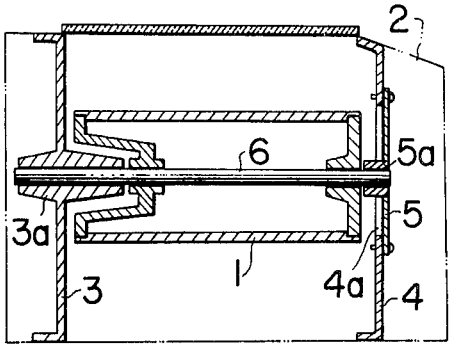
FIG. 1 is a schematic axial sectional view of a conventional electrophotographic copying machine.
Figure 2:
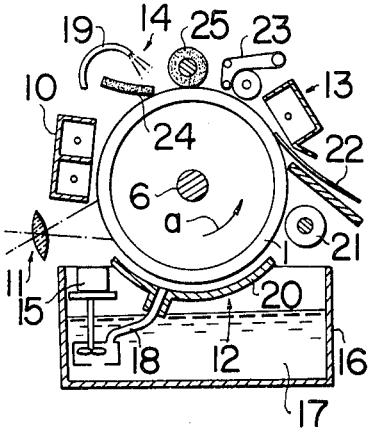
FIG. 2 is a more detailed sectional view of the copying machine shown in FIG. 1.

Referring to FIGS. 1 and 2, there is shown a conventional electrophotographic copying machine which includes a photosensitive drum 1. The machine also includes a body 2 having walls including a sideplate 3 which is provided with a bearing 3*a*, and an opposite sideplate 4, which is formed with an opening 4*a*for allowing the drum to be passed therethrough for the purpose of mounting and dismounting. A coverplate 5 is attached to the sideplate 4, and is provided with another bearing 5*a*. A shaft 6 is rotatably mounted in the bearings 3*a* and 5*a* and fixedly carries the drum 1 thereon. When the coverplate 5 is removed from the sideplate 4, the drum 1 can be passed through the opening 4*a* to be disassembled from the body 2 of the machine. As shown in FIG. 2, a plurality of accessories are disposed around the drum 1, including a charger 10, an exposure unit 11, a developing unit 12, a transfer unit 13 and a cleaning unit 14. Desribing one copying cycle of the copying machine shown with reference to FIG. 2, the drum 1 is rotated in the direction of an arrow *a*, and an electrostatic latent image of an original is formed on the photosensitive surface of the drum 1 by the charger 10 and the exposure unit 11. A pump 15 supplies a toner, containing liquid 17 which is contained within a tank 16, through feed pipes 18, 19 to a developing dishplate 20 and the cleaning unit 14, respectively, thus converting the latent image into a visual image or a toner image. An excess amount of toner solution which is supplied to the drum 1 is removed by a sqeezing roller 21, and the toner image is transferred onto a record sheet 22 in the transfer unit 13. The sheet 22 is separated from the surface of the photosensitive drum by a sheet separator 23 and is conveyed to a delivery table, not shown.

In the copying machine described above, there remains a toner image of a reduced density on the photosensitive surface of the drum after the toner image has been transferred onto the record sheet, and such residual toner image may be transferred onto a next record sheet as a ghost. In order to remove such residual toner image, the cleaning unit 14 comprises a plurality of cleaning members such as a blade 24 and a sponge roller 25, as shown in FIG. 2, constituting first and second cleaning means.

Figure 3:
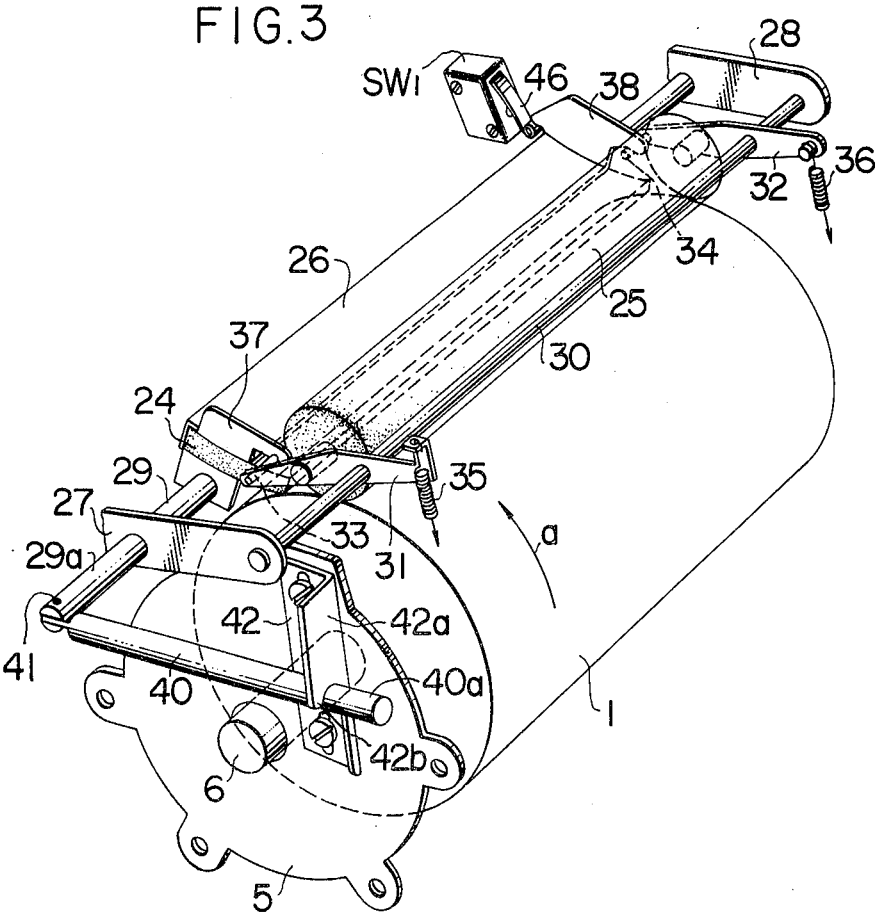
FIG. 3 is a perspective view of one embodiment of the invention.

FIG. 3 shows one embodiment of the cleaning unit according to the invention. It should be noted that parts corresponding to those shown in FIGS. 1 and 2 are designated by like numerals. In accordance with the invention, the blade 24 is in the form of an elongate strip of a resilient material such as rubber or vinyl chloride with an edge formed thereon, and is detachably mounted on a channel-shaped retaining member 26. A pair of brackets 27, 28 are secured to the pair of sideplates 3, 4 (see FIG. 1 ) of the body 2 of the copying machine, and rotatably carries a shaft 29 on which the retaining member 26 is fixedly mounted. The shaft 29 extends in parallel relationship with the shaft 6 which carries the drum. The free ends of the respective brackets 27, 28 fixedly carry the opposite ends of a stationary shaft 30 which extends parallel to the shaft 29. The sponge roller 25 is rockably mounted on respective first arms of a pair of levers 31, 32 which constitute lever means are rockably mounted on the stationary shaft 30. These arms of the levers 31, 32 fixedly carry pins 33, 34, respectively, at their free ends. The levers 31, 32 also include opposite arms which are engaged by first ends of respective springs 35, 36, the other ends of which are secured to a stationary member (see FIGS. 4 and 5). At its opposite ends, the blade retaining member 26 is fixedly provided with lever means in the form of a pair of tabs 37, 38, which are formed with respective projections 37*a*, 38*a*, (FIGS. 4 and 5) at positions toward the sponge roller 25. The lower edges of the respective projections 37*a*, 38*a* are engaged by pins 33, 34, respectively, whereby the bias of the springs 35, 36 acts through the retaining member 26 and rockable levers 31, 32 to move the edge of the blade 24 and the peripheral surface of the sponge roller 25 in a direction away from the photosensitive surface of the drum 1. The projections 37*a*, 38*a*, and the pins 33, 34 constitute means interlocking the two lever means for conjoint operation.

One end 29*a* of the rotary shaft 29 which is located nearer the coverplate 5 extends through the bracket 27 to the exterior of the body 2, and one end of a release lever 40 which functions in retracting the cleaning members, that is, the blade and sponge roller, away from the surface of the drum, is pivotally connected with the end 29*a* by a locking pin 41. The free end 40*a* of the release lever 40 is engaged with a recessed detent 42*b* formed in the lower end of a rising portion 42*a* of a detent member 42 which is formed in its base portion with a pair of spaced elongate slots 42*a*, 42*b*, through which set screws 43, 44 extend to secure the member 42 to the coverplate 5. In the position shown in FIG. 4, the blade 24 and the sponge roller 25 are maintained in abutment against the peripheral surface of the drum 1 by rotating the release lever 40 clockwise, as viewed in FIG. 4, against the resilience of the springs 35, 36 until the free end 40*a* is engaged with the detent 42*b* of the detent member 42. It is to be understood that the contact pressure of the blade 24 and sponge roller 25 against the drum 1 is determined by the angular position of the rotary shaft 29 and hence of the release lever 40, which is in turn achieved by a vertical movement of the detent member 42 as permitted by the engagement between the slot 42a, 42b and the set screws 43, 44.

Figure 5:
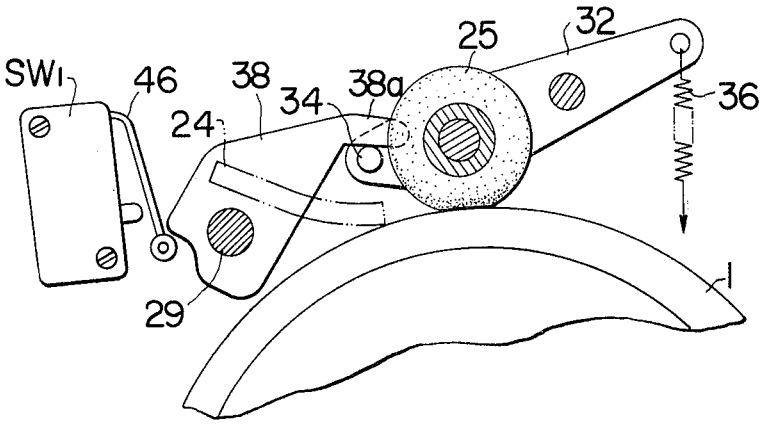

As shown in FIG. 5, located adjacent to the tab 38 on the blade retaining member 26 is the free end of an actuator 46 of a micro-switch SW1, the contacts of which are changed as the free end 40*a* of the release lever 40 is disengaged from the detent 42*b* to permit the retaining member 26 to rotate counterclockwise, as viewed in FIG. 5, against the bias of the springs 35, 36 so as to move the tab 38 into abutment against the actuator 46.

Figure 6:
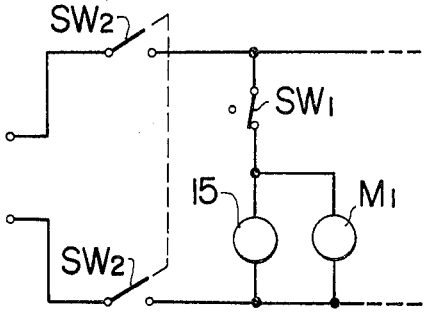
FIG. 6 is a circuit diagram of an electrical circuit which is used in the embodiment of FIG. 3.

The switch SW1 is connected in a power circuit for the pump 15 and a drive motor M1 which drives the photosensitive drum, as shown in FIG. 6. When the cleaning members are moved away from the peripheral surface of the photosensitive drum, the switch SW1 is opened to deenergize the pump and the motor. The circuit shown in FIG. 6 also includes a power switch SW2.

In a conventional copying machine, there has been provided a safety switch for interrupting the operation of the pump and the motor as the coverplate is opened. However, in the construction of the invention, the interruption of the operation of the pump and the motor, which takes place in interlocked relationship with the release operation of the cleaning members, permits and facilitates an inspection of a flow of the developing solution and the manner of operation of the pump and other machine elements while the copying machine is actually operating, by merely opening the coverplate. It should be also noted that the switch SW1 may be replaced by a double pole switch so that a display circuit which indicates the remaining quantity of the developing solution may be operated as the switch SW1 is turned off, thus facilitating a supplemental supply of the developing solution. Alternatively, an agitation unit may be driven to agitate the developing solution as it is replenished when the switch SW1 is turned off.

In the arrangement described above, when the cleaning members are maintained in abutment against the surface of the photosensitive drum, the switch SW1 is closed to rotate the drum, so that the drum cannot be removed when it is engaged by the cleaning members, thus removing the likelihood of damage being caused to the photosensitive member of the cleaning members. Similarly, when the cleaning members are disengaged from the drum surface, the drive motor is not energized, thus preventing a copying operation under the condition that one of the cleaning members may not be in proper engagment with the drum surface. It is to be noted that the switch SW1 may be located at any other desired place, provided it can be operated or opened in response to a release operation of the cleaning members.

Figure 7:
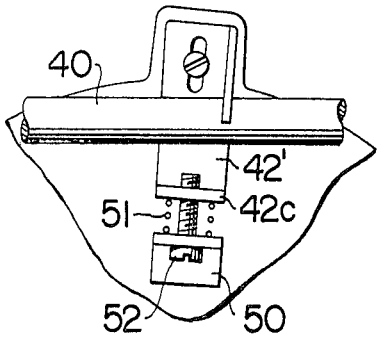
FIGS. 7 to 9 are fragmentary views of other embodiments of the invention which include a mechanism for adjusting the contact pressure between the individual cleaning members and the photosensitive drum.
Figure 8:
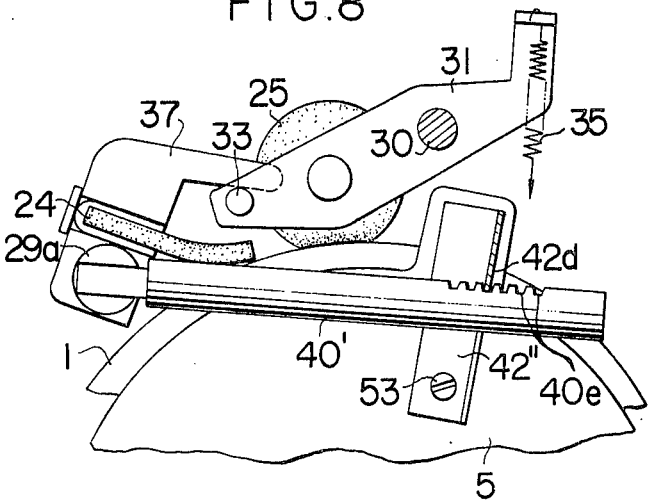

FIG. 7 shows an alternative arrangement to adjust the contact pressure between the cleaning members and the drum surface. Specifically, an L-shaped stationary member 50 is secured to the coverplate 5 at a position below the detent member 42′, the lower end of which is formed with a bent end 42*c*, with a compression spring 51 interposed between the bent end 42*c* and the rising portion of the member 50. The detent member 42′ may be moved in a direction substantially perpendicular to the release lever 40 to change the angular position thereof. Alternatively, FIG. 8 shows a detent member 42″ which is rotatably mounted on the coverplate 5 as by a set screw 53 with a leaf spring interposed therebetween to thereby prevent a free movement thereof. In the region of the detent 42*d*, the release lever 40′ is formed with a plurality of teeth 40*e* which constitute a rack, so that, as the detent member 42″ is rotated about the screw 53, one of the teeth 40*e* may be selectively engaged with the detent 42*d* to change the angular position of the release lever 40′.

Figure 4:
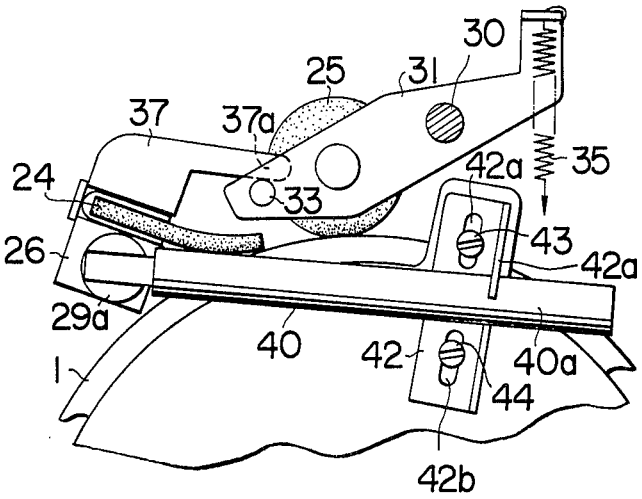
FIGS. 4 and 5 are fragmentary views illustrating parts of the embodiment shown in FIG. 3.
Figure 9:
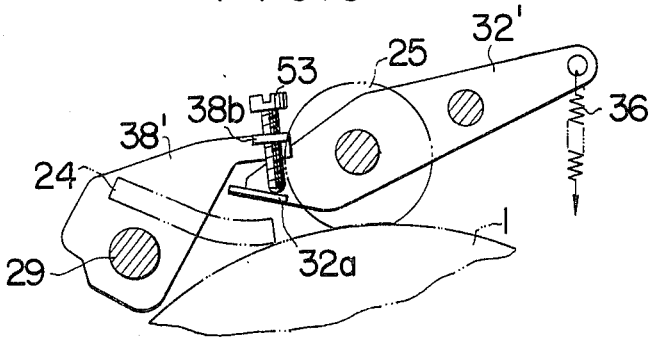

In the arrangement of FIG. 4, the relative position of projections 37*a*, 38*a* from the tabs 37, 38 on the blade retaining member 36 and the pins 33, 34 fixedly mounted on the levers 31, 32 is chosen such that a proper contact pressure is established between the blade 24 and the sponge roller 25, on one hand, and the photosensitive drum on the other hand, as the release lever 40 engages the detent member 42. However, as illustrated, in FIG. 9, a bent portion 38*b* may be formed on the tab 38*a* and threadably engaged by a screw 53, the free end of which bears against a bent portion 32 *a* formed on the free end of the lever 32′ so as to replace the pin 34 in adjusting the contact between the blade 24 and the sponge roller 25, on one hand, and the photosensitive drum, on the other hand, which is achieved by turning the screw to change the spacing between the bent portions 31*a*, 32*a*. It will be appreciated that a similar arrangement is provided on the other tab 37 and the other lever 33. This may prove to be practically effective to correct a change in the contact pressure which might result from a change in the diameter of the sponge roller 25.

What is claimed is:

1. A construction of electrophotographic copying machines comprising:

a. a photosensitive drum, b. a pair of sidewalls rotatably mounting said drum therebetween, one of said sidewalls having an opening to permit the drum to pass therethrough;

c. a coverplate detachably mounted on said one sidewall to cover said opening, d. first and second cleaning means, extending across said drum between said sidewalls for movement between respective first positions in engagement with said drum and respective second positions spaced from said drum, said cleaning means in said first positions, engaging said drum at respective contact areas, which are circumferentially spaced from each other, e. first and second lever means pivotally mounted between said pair of sidewalls on respective shafts extending between said pair of sidewalls, for respectively supporting said first and second cleaning means, one end of one shaft extending through and beyond one sidewall, f. means interlocking said first and second lever means for conjoint movement, g. spring means biasing one of said first and second lever means to move, through said interlocking means, both said first and second cleaning means away from the drum peripheral surface, h. release lever means connected to said one end of said one shaft, and i. detent means mounted at a fixed position on said cover plate, and releasably engageable with said release lever means to maintain said one shaft in a preset angular position, against the bias of said spring means, and in which said preset angular position said first and second cleaning means are engaged with the drum peripheral surface, at said respective contact areas.

2. A construction according to claim 1, wherein said release lever means comprises an elongated lever having one end thereof pivotally connected to said one end of said one shaft about an axis perpendicular to the axis of said one shaft.

3. A construction according to claim 2, wherein said detent means comprises a detent member having a detent portion releasably engageable with the other end of said elongated lever and adjustably movable on said coverplate so as to permit said preset angular position of said one shaft to be adjusted.

4. A construction according to claim 1, wherein said first lever and second lever means comprises a first and a second lever having respective free ends extending in juxtaposed relationship to each other, and said interlocking means comprises a pair of abutting members formed on said respective free ends of said first and second levers and arranged in abutting engagement with each other.

5. A construction according to claim 4, wherein said interlocking means further comprises means for effecting the abutting engagemnt between said pair of abutting members therethrough and and operable to adjust the space between said pair of abutting members.

6. A construction according to claim 5, wherein said adjusting means comprises a screw threaded in one of said pair of abutting members and having one end thereof abutting on the other abutting member.

7. A construction according to claim 1, wherein said copying machine comprises a main motor for driving said drum, and further comprising means sensing the angular position of said one shaft and deenergizing said main motor when said one shaft rotates beyond said preset angular position under the bias of said spring means.

8. A construction according to claim 7, wherein said sensing and deenergizing means comprises a microswitch having its actuating member positioned in the path of movement of one of said first and second lever means.

9. A construction according to claim 1, wherein said copying machine comprises a tank for containing a developing solution, a stirrer for stirring the solution in said tank and a motor for driving said stirrer, and further comprising means sensing the angular position of said one shaft and deenergizing said motor when said one shaft rotates beyond said preset angular position under the bias of said spring means.

* * * * *